US009897939B2

(12) United States Patent
Itabashi

(10) Patent No.: US 9,897,939 B2
(45) Date of Patent: Feb. 20, 2018

(54) DEVELOPER CARTRIDGE

(71) Applicant: Brother Kogyo Kabushiki Kaisha, Nagoya-shi, Aichi-ken (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/472,354

(22) Filed: Mar. 29, 2017

(65) Prior Publication Data

US 2017/0285524 A1 Oct. 5, 2017

(30) Foreign Application Priority Data

Mar. 31, 2016 (JP) ..... 2016-070262

(51) Int. Cl.
*G03G 15/08* (2006.01)

(52) U.S. Cl.
CPC ..... *G03G 15/0881* (2013.01); *G03G 15/0891* (2013.01)

(58) Field of Classification Search
CPC ..... G03G 15/0881; G03G 15/0891; G03G 15/0884; G03G 15/0843; G03G 2215/069
See application file for complete search history.

(56) References Cited

U.S. PATENT DOCUMENTS 5,402,216 A * 3/1995 Komaki ..... G03G 15/0875 141/346
9,063,464 B2 6/2015 Furutani et al.
2013/0336679 A1 12/2013 Furutani et al.
2014/0086620 A1* 3/2014 Takeuchi ..... G03G 15/0882 399/106
2014/0093272 A1* 4/2014 Matsumaru ..... G03G 15/0881 399/106
2014/0126928 A1* 5/2014 Batori ..... G03G 21/1832 399/106

FOREIGN PATENT DOCUMENTS

JP 2014-016592 A 1/2014

* cited by examiner

*Primary Examiner* — Sandra Brase
(74) *Attorney, Agent, or Firm* — Banner & Witcoff, Ltd.

(57) ABSTRACT

A developer cartridge includes a casing and a developer container detachably attached to the casing. The developer container includes a tubular member, a conveyor, an end member, and a sealing member. The tubular member is configured to contain developer therein and has an axis. The conveyor is disposed in the tubular member and is configured to convey the developer toward one end of the tubular member along the axis. The end member is disposed at a predetermined distance away from the one end of the tubular member. The sealing member is attached to an outer peripheral surface of the end member and an outer peripheral surface of the tubular member, and is configured to be broken with rotation of at least one of the tubular member and the conveyor.

16 Claims, 9 Drawing Sheets

DEVELOPER CARTRIDGE

CROSS-REFERENCE TO RELATED APPLICATION

This application claims priority from Japanese Patent Application No. 2016-070262 filed on Mar. 31, 2016, the content of which is incorporated herein by reference in its entirety.

FIELD OF DISCLOSURE

Aspects of the disclosure relate to a developer cartridge including a casing, and a developer container disposed in the casing and containing developer.

BACKGROUND

A known cartridge contains developer therein and may also hold a developing roller therein. The developer in the cartridge may deteriorate before use, for example, due to moisture over a long period of storage. One solution to this problem is to keep developer in a sealed separate container, and dispose the sealed container in a casing of the cartridge. A known developer cartridge includes a casing and a baglike developer container that is disposed in the casing and contains developer. The developer container has an outlet sealed by a film. Removing the film causes the outlet to be open, allowing the developer to flow out of the developer container through the outlet.

SUMMARY

The developer tends to flow out of the baglike developer container due to its own weight, but some developer may remain in the developer container.

One or more aspects of the disclosure provide a developer cartridge including a casing and a developer container detachably attached to the casing. The developer container may include a tubular member, a conveyor, an end member, and a sealing member. The tubular member may be configured to contain developer therein and may have an axis. The conveyor may be disposed in the tubular member and may be configured to convey the developer toward one end of the tubular member along the axis. The end member may be disposed at a predetermined distance away from the one end of the tubular member. The sealing member may be attached to an outer peripheral surface of the end member and an outer peripheral surface of the tubular member, and may be configured to be broken with rotation of at least one of the tubular member and the conveyor.

DETAILED DESCRIPTION

Figure 1:
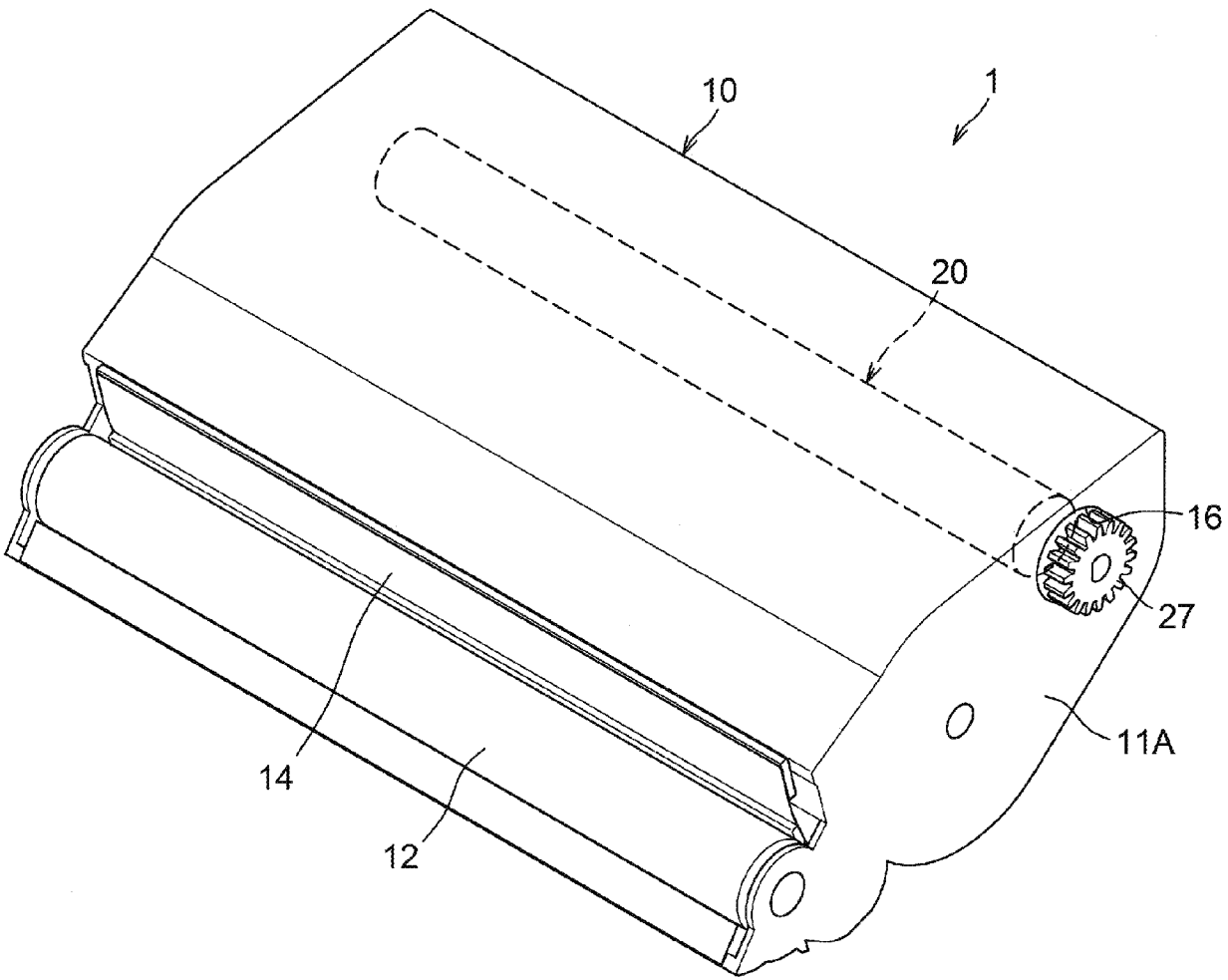
FIG. 1 is a perspective view of a developer cartridge in an illustrative embodiment according to one or more aspects of the disclosure.

Illustrative embodiments and modifications thereof according to one or more aspects of the disclosure are described in detail below with reference to the accompanying drawings, wherein similar reference numerals may correspond to similar components throughout the various drawings.

First Illustrative Embodiment

As depicted in FIG. 1, a developer cartridge 1 according to a first illustrative embodiment includes a casing 10 and a developer container 20. A portion of the developer container 20 containing developer, e.g., toner T, is received in the casing 10. The casing 10 includes a side wall 11A having an opening 16, and a side wall 11B (in FIG. 3) opposite to the side wall 11A. Hereinafter, the side wall 11B may be referred to as the "first side wall" and the side wall 11A may be referred to as the "second side wall". The developer container 20 may be disposed into and removed from the casing 10 through the opening 16. The developer container 20 includes a drive force transmitter, e.g., a gear 27. The gear 27 is disposed outside the casing 10.

Figure 2:
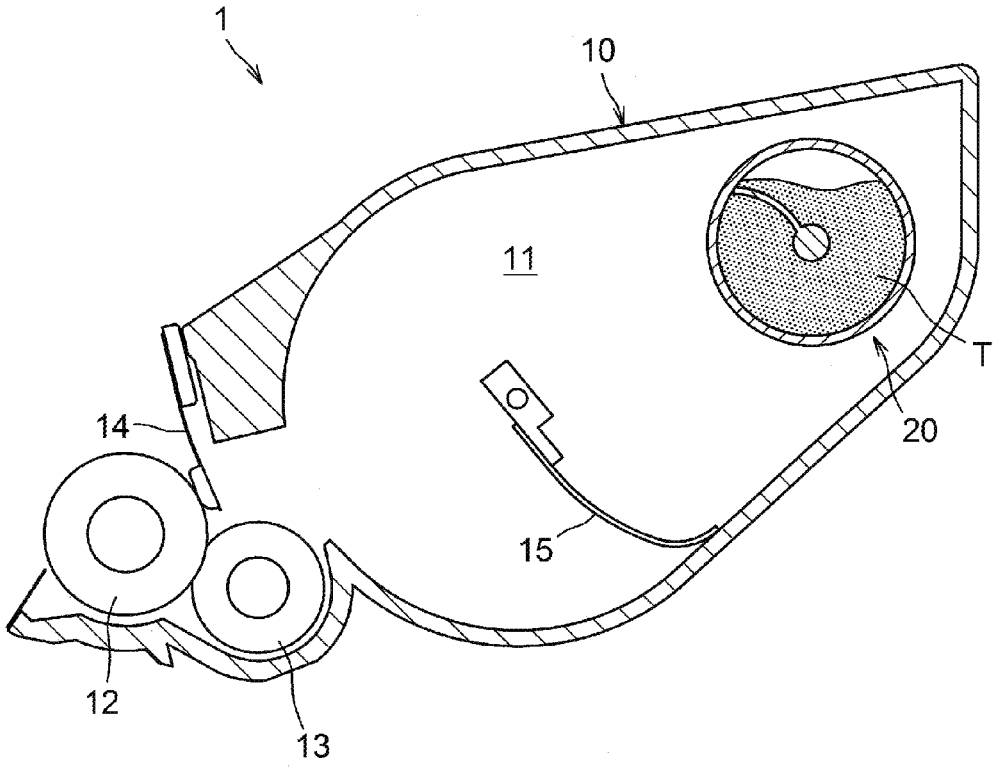
FIG. 2 is a cross-sectional view of the developer cartridge according to one or more aspects of the disclosure.

As depicted in FIG. 2, the developer cartridge 1 includes a developing roller 12, a supply roller 13, a blade 14, and an agitator 15 that are housed in the casing 10. The developer cartridge 1 further includes a developer chamber 11 configured to receive and store the toner T discharged from the developer container 20.

The developing roller 12 is rotatably support by the casing 10.

The supply roller 13 is also rotatably supported by the casing 10, and configured to supply the toner T to the developing roller 12.

The blade 14 contacts the developing roller 12 to regulate a thickness of a toner layer on a surface of the developing roller 12.

The agitator 15 is disposed in the developer chamber 11 and rotatably supported by the casing 10. The agitator 15 is configured to be rotated by external drive force to agitate the toner T in the chamber 11.

Figure 3:
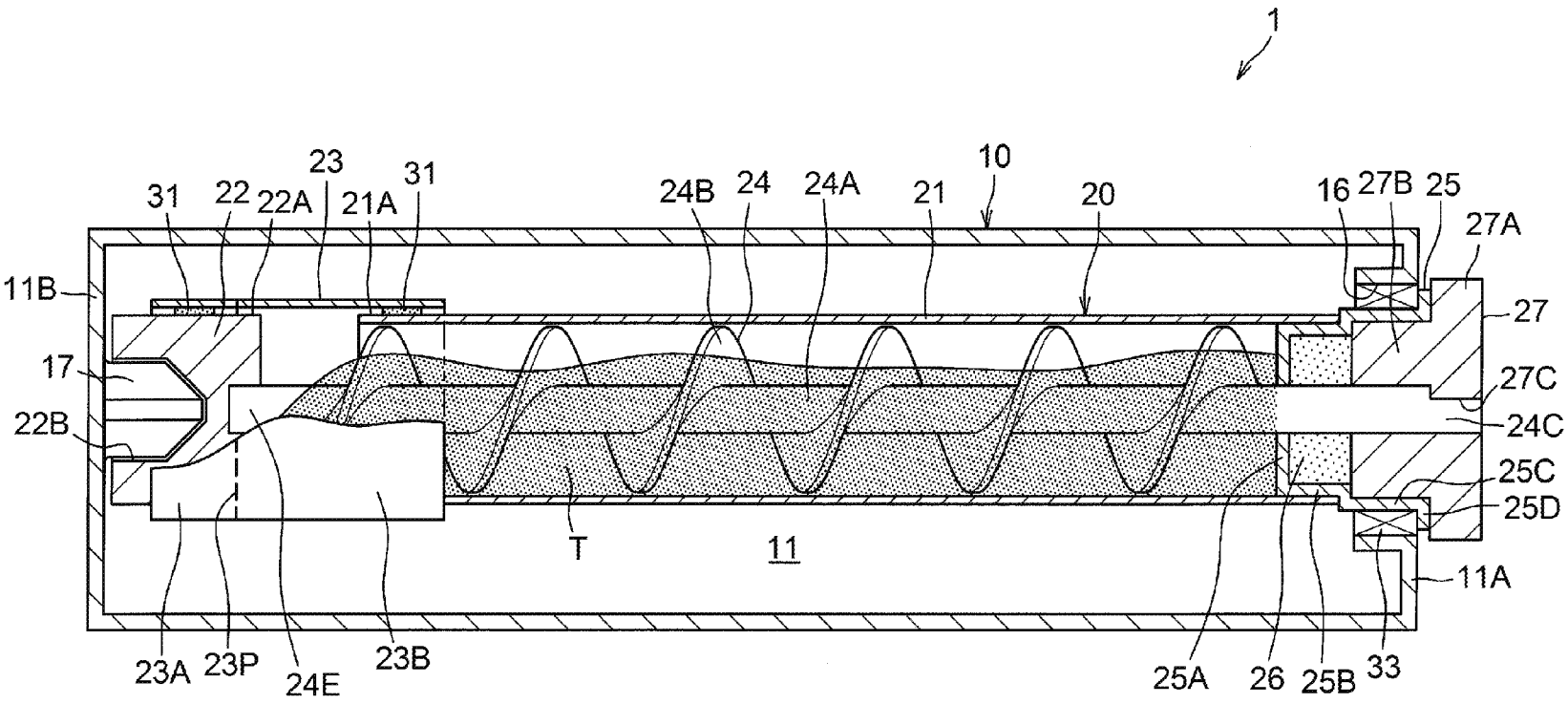
FIG. 3 is a cross-sectional view of the developer cartridge taken along an axis of a developer container of the developer cartridge according to one or more aspects of the disclosure.

As depicted in FIG. 3, the developer container 20 includes a tubular member 21, an end member 22, a sealing member 23, a conveyor, e.g., an auger 24, a cap 25, and the gear 27. An end of the developer container 20 opposite to the gear 27 may be referred to as the "first" end and the other end of the developer container 20 having the gear 27 may be referred to as the "second" end as will various other parts of the developer cartridge 1.

The tubular member 21 has a cylindrical shape and an outer peripheral surface 21A. The tubular member 21 contains the toner T.

The end member 22 also has an outer peripheral surface 22A. The end member 22 has the same diameter as the tubular member 21. The end member 22 is disposed to the left of the tubular member 21 with a space therebetween. The end member 22 has a cross-shaped recess 22B formed into a first end surface thereof. The first side wall 11B of the casing 10 has a cross-shaped protrusion 17 protruding from an inner surface thereof. The recess 22B and the protrusion 17 engage with each other to prevent the end member 22 from rotating relative to the casing 10.

The sealing member 23 is attached to the outer peripheral surface 21A of the tubular member 21 and the outer peripheral surface 22A of the end member 22, thereby sealing a space between the members 21 and 22. In the illustrative embodiment, the sealing member 23 is attached to the tubular member 21 and the end member 22 by adhesives 31. In another embodiment, the sealing member 23 may be attached to those members 21 and 22 by, for example, gluing agent or welding.

The sealing member 23 has a weakened portion, e.g., a perforation 23P, that may be weaker than other or remaining portions of the sealing member 23. The sealing member 23 is likely to break along the perforation 23P rather than other areas of the sealing member 23. The perforation 23P runs along a rotating direction of the auger 24. The perforation 23P divides the sealing member 23 into a first portion 23A and a second portion 23B. The first portion 23A is attached to the end member 22 and the second portion 23B is attached to the tubular member 21.

The perforation 23P may include through-holes extending through the sealing member 23. Alternatively, the perforation 23P may include notches and scores formed into, but not through, the sealing member 23. In the illustrative embodiment, the perforation 23P is provided facing the outer peripheral surface 22A of the end member 22. This configuration may prevent or reduce the toner T from leaking out of the tubular member 21 through the through-holes of the perforation 23P before the sealing member 23 breaks.

The auger 24 includes a shaft 24A and a helical screw blade 24B integrally provided around the shaft 24A. The shaft 24A has a first end portion 24E disposed at an end portion thereof (e.g., a left end portion in FIG. 3) and a second end portion disposed at an opposite end portion thereof (e.g., a left end portion in FIG. 3). The first end portion 24E is rotatably supported by the end member 22. The second end portion has an engaging portion 24C with a D-shaped cross section. The auger 24 is configured to rotate integrally with the gear 27 with the engaging portion 24C of the auger 24 engaging a D-shaped opening 27C in the gear 27. Rotating force transmitted to the auger 24 through the gear 27 may cause the auger 24 to rotate in a particular direction, thereby conveying the toner T along an axis of the tubular member 21 toward the first end of the tubular member 21, e.g., leftward in FIG. 3.

The cap 25 seals or covers the second end of the tubular member 21 (e.g., the right end in FIG. 3). The cap 25 includes a disk portion 25A, a small diameter portion 25B, a large diameter portion 25C, and a flange 25D. The disk portion 25A has an opening through which the shaft 24A is inserted. The small diameter portion 25B is cylindrical and extends rightward in FIG. 3 from a peripheral edge of the disk portion 25A. The large diameter portion 25C is cylindrical and extends from the second end of the small diameter portion 25B to have a greater diameter than the small diameter portion 25B. The flange 25D extends from the second end of the large diameter portion 25C in a radial direction of the large diameter portion 25C.

The small diameter portion 25B engages in the tubular member 21. This allows the cap 25 and the tubular member 21 to rotate together. The small diameter portion 25B includes a sponge sealing member 26. The sealing member 26 may reduce leakage of the toner T from a portion between the shaft 24A and the gear 27.

The large diameter portion 25C has an outside diameter slightly greater than an outside diameter of the tubular member 21. The large diameter portion 25C is supported by a wall of the casing 10 defining the opening 16, via a bearing 33. The bearing 33 serves as a sealing member that fills a space between the casing 10 and the cap 25.

The gear 27 includes a gear portion 27A, and a shaft portion 27B cylindrically extending from the first end of the gear portion 27A. The shaft portion 27B receives the shaft 24A. The shaft portion 27B is press-fitted into the large diameter portion 25C of the cap 25. This allows the cap 25 and the gear 27 to rotate together. Accordingly, all of the gear 27, the cap 25, the tubular member 21, and the auger 24 may integrally rotate relative to the casing 10. In contrast, the end member 22 may not rotate relative to the casing 10. Rotation of the gear 27 may cause the tubular member 21 to rotate, which may cause the sealing member 23 to be twisted and break at the perforation 23P.

Figure 4A:
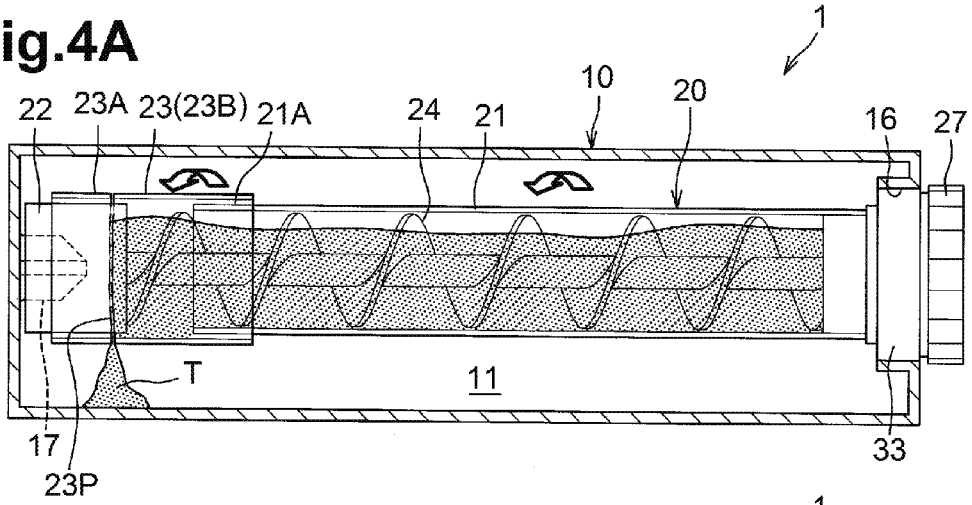
FIGS. 4A-4C illustrate toner flowing out of the developer container into a portion of a casing of the developer cartridge according to one or more aspects of the disclosure.

In operation, the gear 27 may receive drive force from an image forming apparatus (not depicted). As depicted in FIG. 4A, the drive force may cause the gear 27 to rotate integrally with the tubular member 21 and the auger 24. The first portion 23A of the sealing member 23 is attached to the outer peripheral surface 22A of the end member 22, which may be non-rotatable relative to the casing 10. The second portion 23B is attached to the outer peripheral surface 21A of the tubular member 21, which may be rotating with the gear 27. Shearing force is applied to the perforation 23P, which is the boundary between the first portion 23A and the second portion 23B. The shearing force may cause the sealing member 23 to start breaking at the perforation 23P. A break in the sealing member 23 at the perforation 23P may allow the toner T to flow out of the developer container 20 therethrough into the developer chamber 11.

Figure 4B:
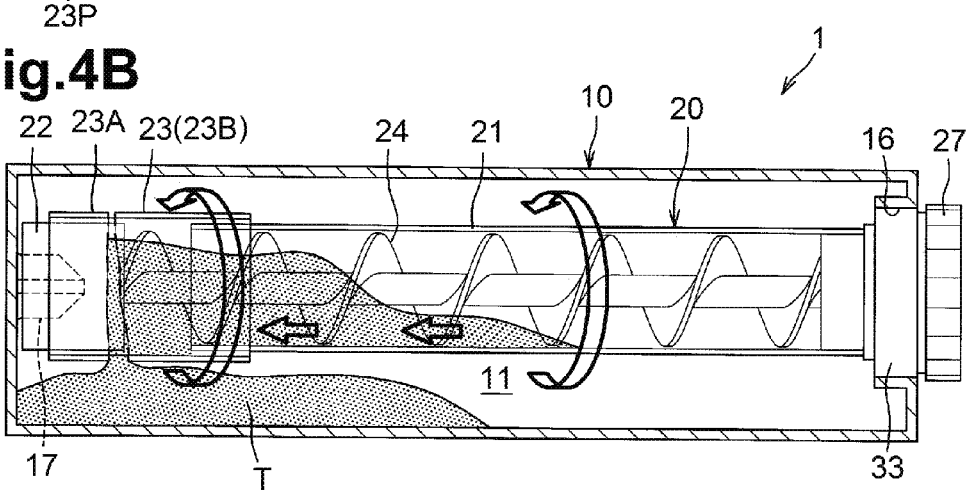

As depicted in FIG. 4B, further rotation of the gear 27 and the auger 24 may cause the toner T in the tubular member 21 to be conveyed toward the first end of the developer container 20, and further rotation of the gear 27 and the tubular member 21 may cause the sealing member 23 to further break and be split apart into the first portion 23A and the second portion 23B. The toner T conveyed toward the first end of the developer container 20 may flow out of the developer container 20 into the developer chamber 11 through the break in the sealing member 23 or through the split between the first portion 23A and the second portion 23B.

Figure 4C:
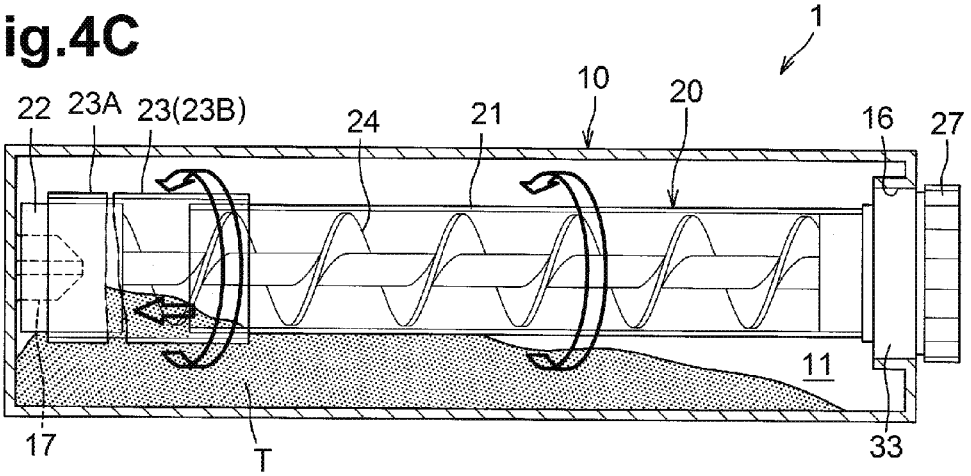
Figure 5:
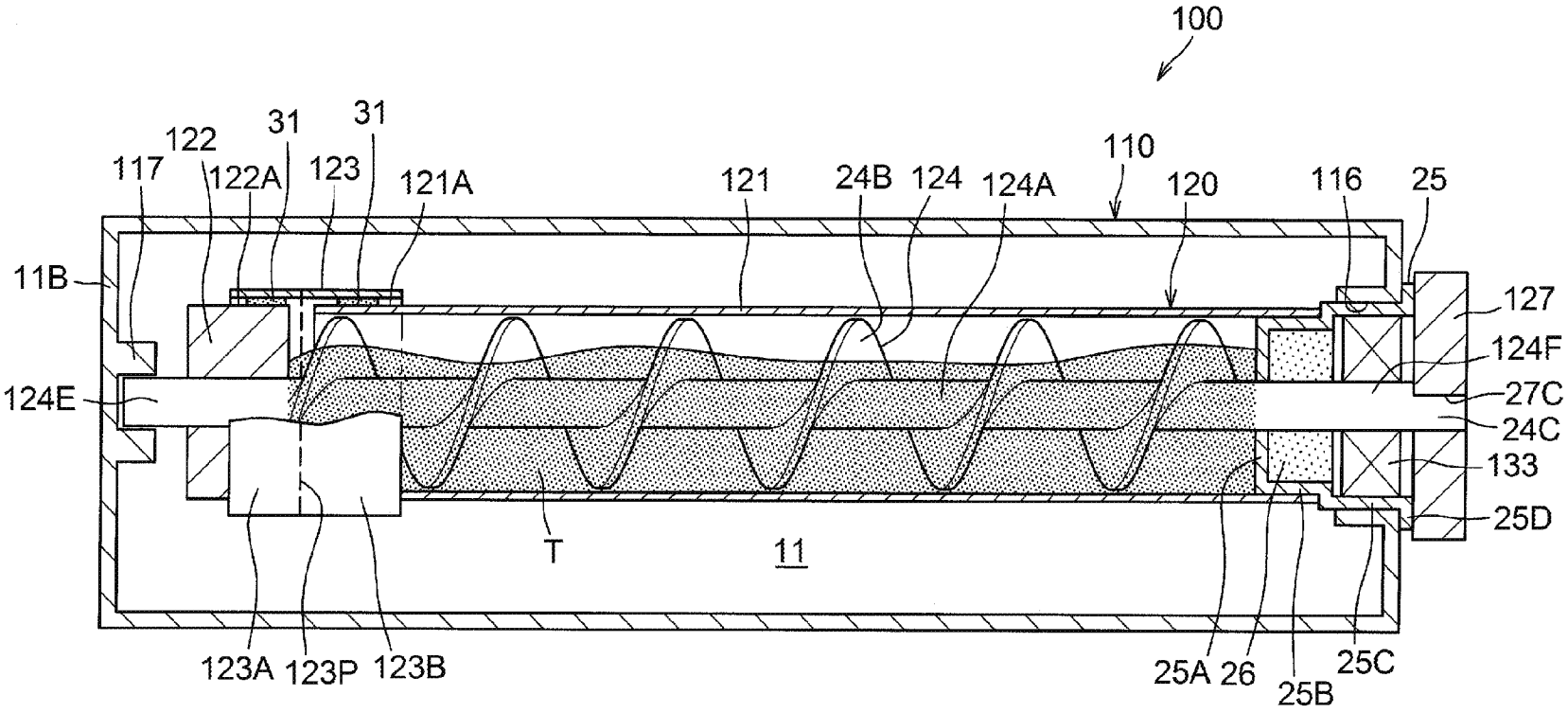
FIG. 5 is a cross-sectional view of a developer cartridge in a second illustrative embodiment according to one or more aspects of the disclosure, wherein the developer cartridge is taken along an axis of a developer container of the developer cartridge.

As depicted in FIG. 4C, further rotation of the gear 27 and the auger 24 may cause the toner T left in the tubular member 21 to be conveyed toward the first end. The majority of the toner T may flow out of the developer container 20 into the developer chamber 11 through the break or split. Only tiny amount of the toner T may thus be left in the developer container 20.

In the first illustrative embodiment, rotation of the tubular member 21 of the developer cartridge 1 may cause the sealing member 23 to break and open at the perforation 23P. The toner T in the tubular member 21 may be conveyed by the auger 24 toward the first end of the developer container 20 and flow out of the tubular member 21 into the developer chamber 11 through a break or a split in the sealing member 23, which is also provided or formed at a first end portion of the developer container 20. This configuration may allow the toner T to be conveyed by the auger 24 for efficient discharge from the developer container 20, which is disposed in the casing 10, and may reduce the residual toner T in the developer container 20.

The perforation 23P faces the outer peripheral surface 22A of the end member 22. This configuration may reduce leakage of the toner T contained in the tubular member 21 through the through-holes of the perforation 23P, before the sealing member 23 breaks.

The developer container 20 is configured to be attached to and removed from the casing 10. This configuration may allow the empty developer container 20 to be replaced with a new developer container 20, for example, for replenishing the developer chamber 11 with the toner T. The developer cartridge 1 is thus usable with a replacement developer container 20, which may enhance the reusability of the developer cartridge 1.

Second Illustrative Embodiment

Next, a developer cartridge 100 according to a second illustrative embodiment is described referring to FIGS. 5 and 6A-6C. Like numerals in the drawings denote like components and the detailed description of those components described above is omitted, with respect to FIGS. 5 and 6A-6C.

The developer cartridge 100 of the second illustrative embodiment differs from the developer cartridge 1 of the first illustrative embodiment in that a tubular member 121 of a developer container 120 is configured not to rotatable relative to a casing 110 but an end member 122 is configured to rotate relative to the casing 110.

The developer container 120 includes the tubular member 121, the end member 122, a sealing member 123, an auger 124, the cap 25, and a gear 127.

The tubular member 121 has an outer peripheral surface 121A. The second end of the tubular member 121 is fitted over the small diameter portion 25B of the cap 25. The large diameter portion 25C of the cap 25 is press-fitted into an opening 116 in the casing 110 without any components (e.g., a bearing) between the casing 110 and the cap 25. This configuration may prevent the tubular member 121 from rotating relative to the casing 110.

The auger 124 includes a shaft 124A having a first end portion 124E and a second end portion 124F. The first end portion 124E is supported by a bearing 117 provided at an inner surface of the first side wall 11B of the casing 110. The second end portion 124F is supported by the large diameter portion 25C of the cap 25 via a bearing 133. This configuration may allow the auger 124 to rotate relative to the casing 110.

The end member 122 has an opening with a greater diameter than the first end portion 124E of the shaft 124A. The first end portion 124E is inserted into the opening in the end member 122. Thus, the end member 122 is fixedly mounted on the first end portion 124E of the shaft 124A. This configuration may allow the end member 122 to rotate integrally with the shaft 124A. The end member 122 has an outer peripheral surface 122A and a diameter equal to that of the tubular member 121.

The sealing member 123 has a perforation 123P provided along a rotating direction of the auger 124. The perforation 123P divides the sealing member 123 into a first portion 123A and a second portion 123B. The first portion 123A is attached to the outer peripheral surface 122A of the end member 122 with the adhesive 31. The second portion 123B is attached to the outer peripheral surface 121A of the tubular member 121 with the adhesive 31. The perforation 123P is positioned between the tubular member 121 and the end member 122.

Figure 6A:
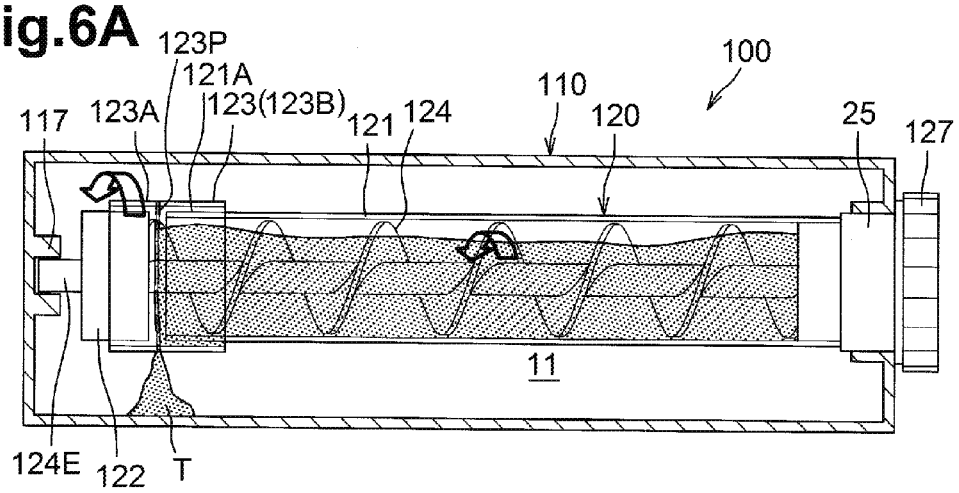
FIGS. 6A-6C illustrate toner flowing out of the developer container in the second illustrative embodiment according to one or more aspects of the disclosure.

In operation, the gear 127 may receive drive force from the image forming apparatus (not depicted). As depicted in FIG. 6A, the drive force may cause the gear 127 to rotate integrally with the auger 124. The first portion 123A of the sealing member 123 is attached to the outer peripheral surface 122A of the end member 122. The end member 122 is fixedly mounted on the first end portion 124E of the auger 124, which is rotatable relative to the casing 110. In contrast, the second portion 123B of the sealing member 123 is attached to the outer peripheral surface 121A of the tubular member 121, which is not rotatable relative to the casing 110. Shearing force is applied to the perforation 123P, which is the boundary between the first portion 123A and the second portion 123B. The shearing force may cause the sealing member 123 to start breaking at the perforation 123P. A break in the sealing member 123 may allow the toner T to flow out of the developer container 120 therethrough into the developer chamber 11.

Figure 6B:
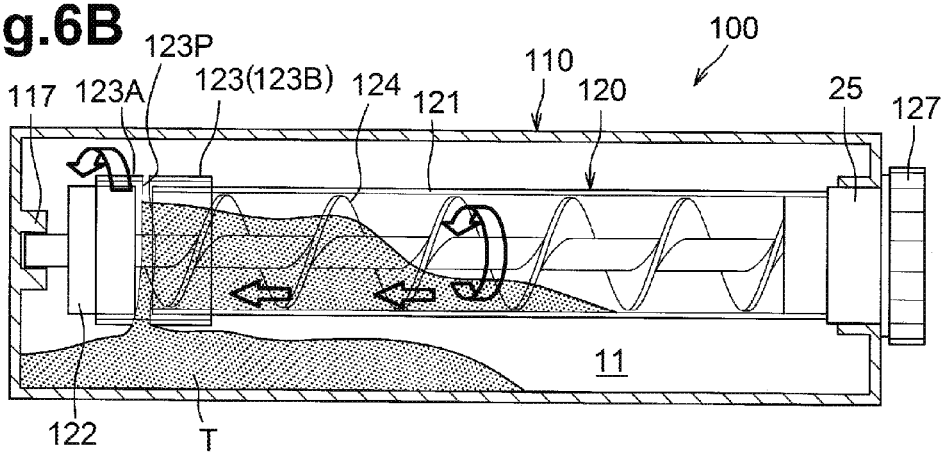

As depicted in FIG. 6B, further rotation of the gear 127 and the auger 124 may cause the toner T in the tubular member 121 to be conveyed toward the first end of the developer container 120, and rotation of the gear 127 and the end member 122 may cause the sealing member 123 to further break and be split apart into the first portion 123A and the second portion 123B. The toner T conveyed toward the first end of the developer container 120 may flow out of the developer container 120 into the developer chamber 11 through the break in the sealing member 123 or through the split between the first portion 123A and the second portion 123B.

Figure 6C:
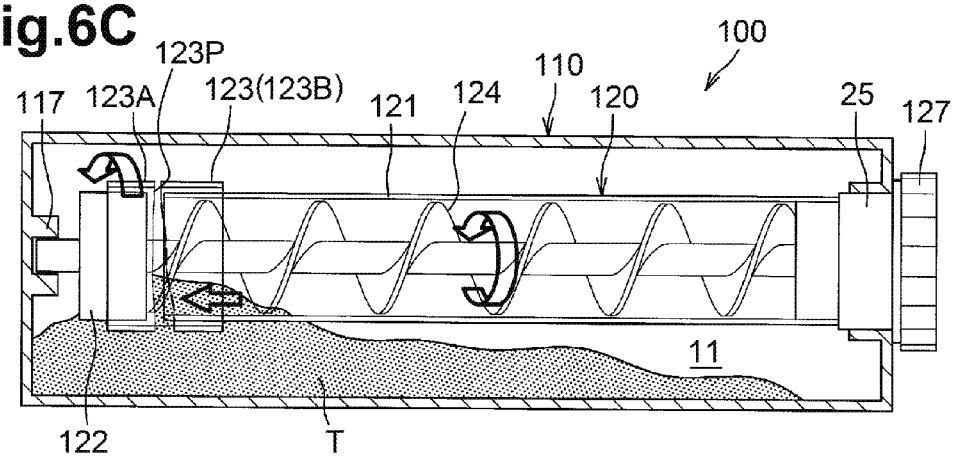

As depicted in FIG. 6C, further rotation of the gear 127 and the auger 124 may cause the toner T left in the tubular member 121 to be conveyed toward the first end. The majority of the toner T may flow out of the developer container 120 into the developer chamber 11 through the break or split. Only tiny amount of the toner T may thus be left in the developer container 120.

In the second illustrative embodiment, rotation of the auger 124 of the developer cartridge 100 may cause the sealing member 123 to break and open at the perforation 123P. The toner T in the tubular member 121 may be conveyed by the auger 124 toward the first end of the developer container 120 and flow out of the tubular member 121 into the developer chamber 11 of the casing 110 through a break or a split in the sealing member 123, which is also provided or formed at a first end portion of the developer container 120. This configuration may allow the toner T to be conveyed by the auger 124 for efficient discharge from the developer container 120, which is disposed in the casing 110, and reduce the residual toner T in the developer container 120.

The perforation 123P is positioned between the tubular member 121 and the end member 122. This configuration may allow smooth flow and efficient discharge of the toner T from the developer container 120 through the break in the sealing member 123.

Third Illustrative Embodiment

Next, a developer cartridge 200 according to a third illustrative embodiment is described referring to FIGS. 7A-7C and 8A-8C. Like numerals in the drawings denote like components and the detailed description of those components described above is omitted, with respect to FIGS. 7A-7C and 8A-8C.

The developer cartridge 200 of the third illustrative embodiment differs from the developer cartridge 100 of the second illustrative embodiment in that the developer cartridge 200 includes a conveyor, e.g., a piston conveyor 224 employing a ball screw mechanism, instead of the auger 124.

Figures 7A, 7B, 7C:
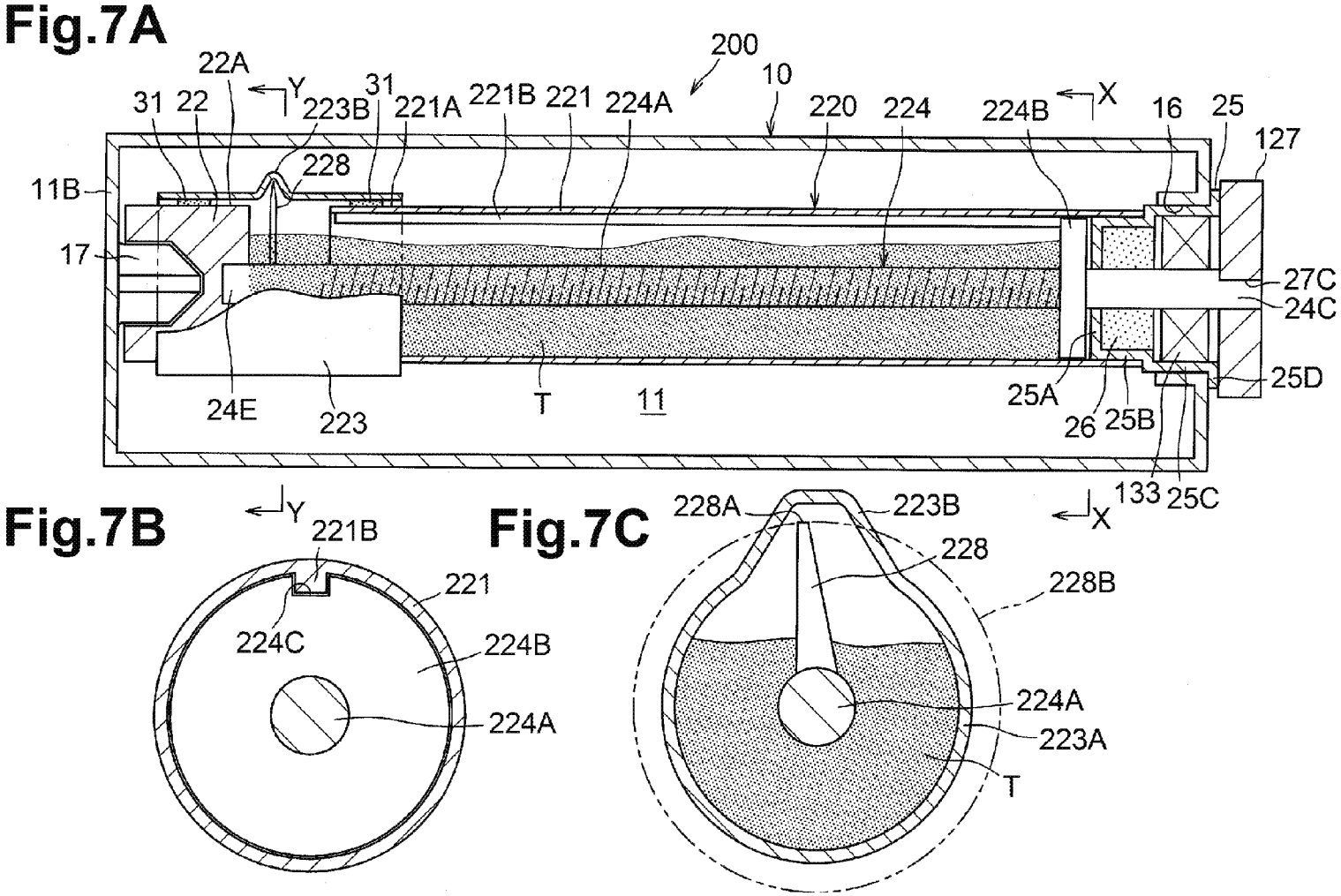
FIG. 7A is a cross-sectional view of a developer cartridge in a third illustrative embodiment according to one or more aspects of the disclosure, wherein the developer cartridge is taken along an axis of a developer container of the developer cartridge.
FIG. 7B is a cross-sectional view of the developer cartridge viewed along a line X-X in FIG. 7A according to one or more aspects of the disclosure.
FIG. 7C is a cross-sectional view of the developer cartridge viewed along a line Y-Y in FIG. 7A according to one or more aspects of the disclosure.

As depicted in FIG. 7A, the developer cartridge 200 includes a developer container 220. The developer container 220 includes a tubular member 221, the end member 22, a sealing member 223, the piston conveyor 224, the cap 25, and the gear 127.

Similar to the second illustrative embodiment, the second end of the tubular member 221 is fitted over the small diameter portion 25B of the cap 25. The large diameter portion 25C of the cap 25 is fixedly press-fitted into the opening 16 in the casing 10 without any components (e.g., a bearing) therebetween. This configuration may prevent the tubular member 221 from rotating relative to the casing 10.

The tubular member 221 has an outer peripheral surface 221A. The tubular member 221 includes a stopper, e.g., a rail 221B. The rail 221B extends from an inner surface of the tubular member 221 between the first end and the second end of the tubular member 221. The rail 221B prevents the tubular member 221 from rotating relative to a piston 224B as described below.

The piston conveyor 224 includes a threaded shaft 224A and the piston 224B.

The threaded shaft 224A has a first end portion 24E rotatably supported by the end member 22, and a second end portion rotatably supported by the large diameter portion 25C of the cap 25 via the bearing 133. The second end portion of the threaded shaft 224A has an engaging portion 24C that engages in the hole 27C of the gear 127. With the engaging portion 24C of the threaded shaft 224A engaging in the hole 27C of the gear 127, the threaded shaft 224A may rotate integrally with the gear 127. The threaded shaft 224A has a cutter 228 fixed to a first end portion thereof. The cutter 228 is configured to rotate integrally with the threaded shaft 224A. The cutter 228 is slightly spaced apart from the end member 22. The cutter 228 has a distal end 228A situated away from the threaded shaft 224A in a radial direction of the tubular member 221.

The piston 224B has a female or internal screw threads (not depicted) that mate with male or external screw threads of the threaded shaft 224A. As depicted in FIG. 7B, the piston 224B has a recess 224C formed in an outer surface thereof. The recess 224C receives the rail 221B of the tubular member 221. This configuration may allow, when the threaded shaft 224A is rotating, the piston 224B to slidably move along an axis of the tubular member 221 without rotating relative to the tubular member 221.

The sealing member 223 has a first end portion attached to the outer peripheral surface 22A of the end member 22 with the adhesive 31, and a second end portion attached to the outer peripheral surface 221A of the tubular member 221 with the adhesive 31. As depicted in FIG. 7C, the sealing member 223 includes a cut portion 223A and a non-cut portion 223B. The cut portion 223A is a portion of the sealing member 223 to be cut by the cutter 228. The cut portion 223A is disposed within an imaginary cylindrical plane 228B whose radius is equal to a distance from an axis of the threaded shaft 224A to the distal end 228A of the cutter 228. The non-cut portion 223B is a portion of the sealing member 223 not to be cut by the cutter 228. The non-cut portion 223B protrudes away from the cutter 228 in the radial direction of the tubular member 221 relative to the cut portion 223A.

Figure 8A:
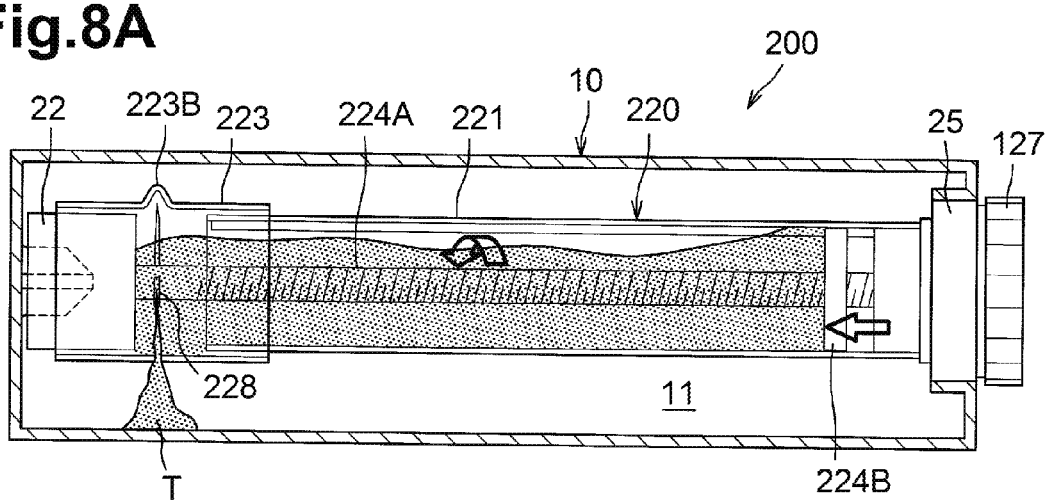
FIGS. 8A-8C illustrate toner flowing out of the developer container in the third illustrative embodiment according to one or more aspects of the disclosure.

The gear 127 may receive drive force from the image forming apparatus (not depicted). As depicted in FIG. 8A, the drive force may cause the gear 127 to rotate integrally with the threaded shaft 224A and the cutter 228. The cutter 228 may cut or break, during rotation, the cut portion 223A of the sealing member 223 other than the non-cut portion 223B. In short, rotation of the threaded shaft 224A, which is a portion of the conveyor, may cause the sealing member 223 to break. The toner T may flow out of the developer container 220 into the developer chamber 11 through a break or cut in the sealing member 223.

Figure 8B:
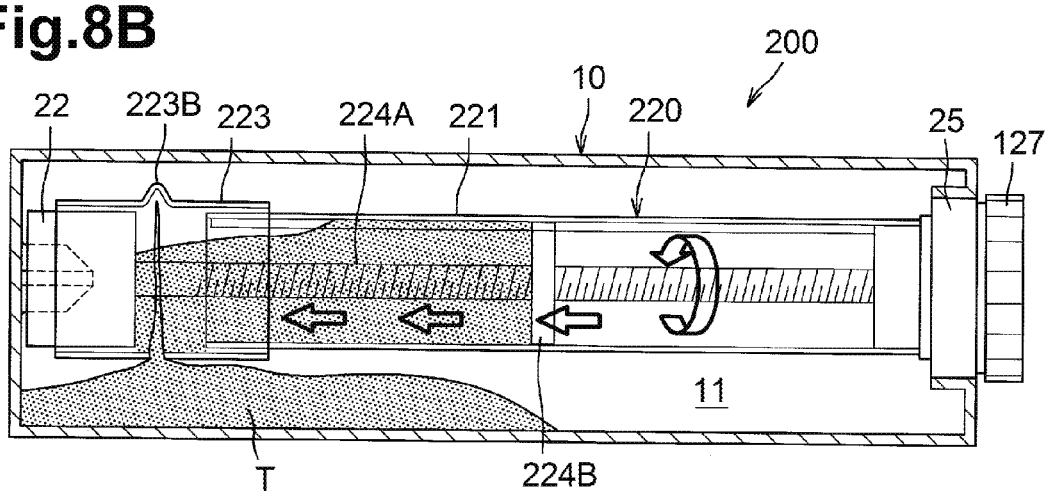

As depicted in FIG. 8B, further rotation of the gear 127 and the threaded shaft 224A may cause the piston 224B to move from the second end toward the first end of the developer container 220, thereby conveying the toner T in the tubular member 221 toward the first end. Also, further rotation of the gear 127 and the threaded shaft 224A may cause the cutter 228 to further cut the sealing member 223. The toner T conveyed toward the first end may flow out of the developer container 220 into the developer chamber 11 through the break or cut in the sealing member 223.

Figure 8C:
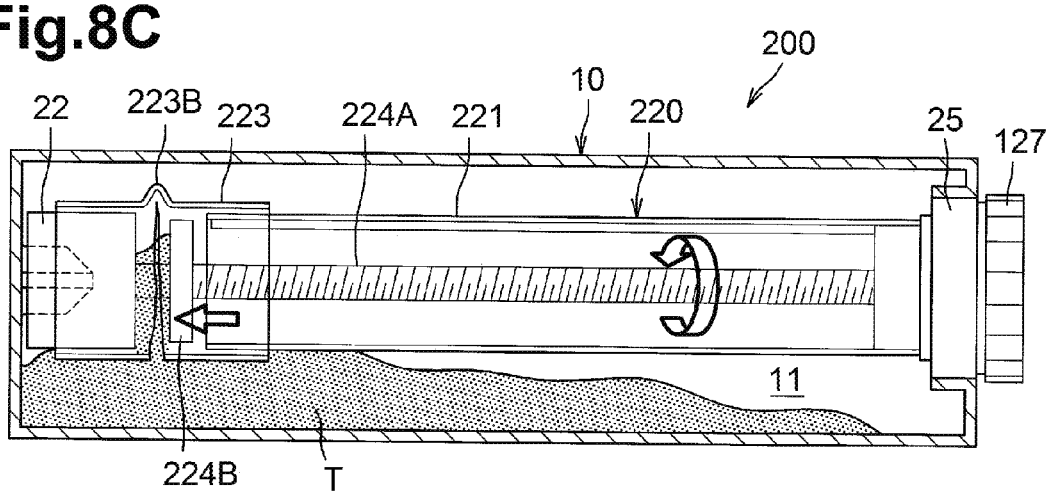

As depicted in FIG. 8C, further rotation of the gear 127 may cause the piston 224B to move further toward the first end of the developer container 220, thereby conveying the toner T left in the tubular member 221 toward the first end. The majority of the toner T in the tubular member 221 may flow out of the developer container 220 into the developer chamber 11 through the break or cut in the sealing member 223. Only tiny amount of the toner T may thus be left in the developer container 220.

In the third illustrative embodiment, rotation of the threaded shaft 224A may cause the cutter 228 to cut and open the sealing member 223. The toner T in the tubular member 221 may be conveyed by the piston 224B toward the first end of the developer container 220 and may flow out of the tubular member 221 into the developer chamber 11 through a break or cut in the sealing member 223, which is also provided or formed at a first end portion of the developer container 220. This configuration may allow the toner T to be conveyed by the piston 224B for efficient discharge from the developer container 220 disposed in the casing 10, and reduce the residual toner T in the developer container 220.

While the disclosure is described in detail with reference to specific embodiments thereof, this is merely an example, and various changes, arrangements and modifications may be applied therein without departing from the spirit and scope of the disclosure.

Figure 9:
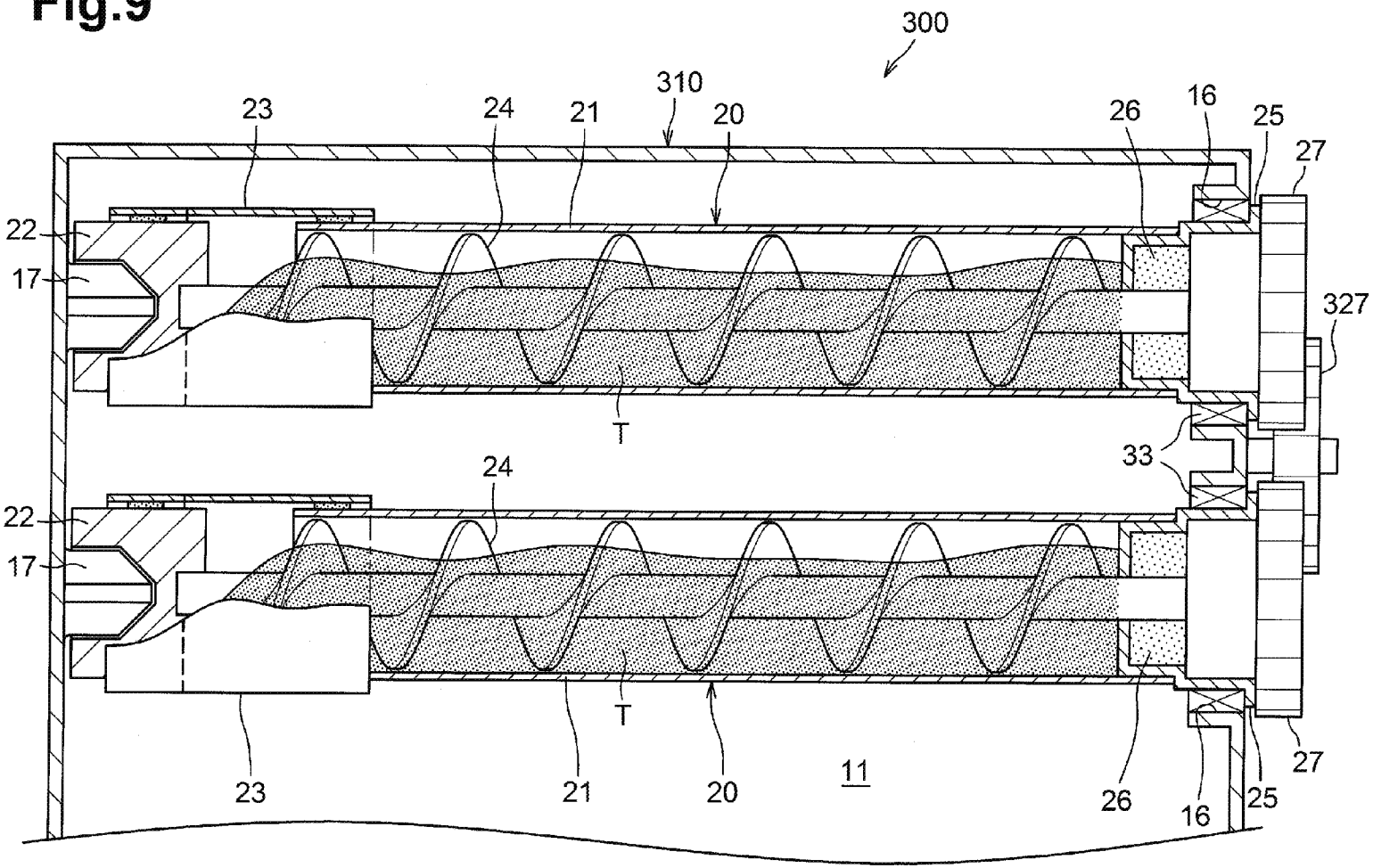
FIG. 9 is a cross-sectional view of a developer cartridge in a modification according to one or more aspects of the disclosure.

For example, in the illustrative embodiments, the casing is configured to receive one developer container. In a modification as depicted in FIG. 9, a developer cartridge 300 may include a casing 310 configured to receive a plurality of developer containers 20. In this configuration, a drive gear 327 may be provided that engages with each of the gears 27 of the developer containers 20. The drive gear 327 may be configured to drive both gears 27.

In the first illustrative embodiment, a weakened portion, e.g., the perforation 23P, is disposed facing the outer peripheral surface 22A of the end member 22. In another embodiment, a weakened portion may be disposed facing the outer peripheral surface 21A of the tubular member 21. This configuration may also prevent or reduce toner leakage through through-holes of the perforation 23P, similar to the first illustrative embodiment.

In the third illustrative embodiment, rotation of the threaded shaft 224A may cause the piston 224B to slidably move. In another embodiment, a threaded shaft may be fixed and a tubular member and a piston may be configured to rotate. The piston may slidably move, while rotating, along the threaded shaft.

In the illustrative embodiments, the developer container is partially inserted into the casing. In another embodiment, the developer container may be fully inserted into the casing.

In the illustrative embodiments, the drive force transmitter is a gear configured to receive and transmit drive force. In another embodiment, the drive force transmitter may be a coupling that engages with a conveyor.

In some illustrative embodiments, the weakened portion is a perforation. In another embodiment, the weakened portion may be a score line, which is thinner than other portion of a sealing member. The sealing member may not necessarily have the weakened portion. For example, a sealing member may be formed with a material that is more readily breakable than a material of the tubular member. Alternatively, the sealing member may be lightly or weakly attached to the tubular member or the end member, to permit the sealing member to readily detach from the tubular member or the end member.

In the illustrative embodiments, the developer cartridge includes the developer roller. In another embodiment, the developer cartridge may not necessarily include the developing roller.

What is claimed is:

1. A developer cartridge comprising:
a casing; and
a developer container detachably attached to the casing and including:
a tubular member configured to contain developer therein and having an axis;
a conveyor disposed in the tubular member and configured to convey the developer toward one end of the tubular member along the axis;
an end member disposed at a predetermined distance away from the one end of the tubular member; and
a sealing member attached to an outer peripheral surface of the end member and an outer peripheral surface of the tubular member to seal a space between the end member and the tubular member, and configured to be broken with rotation of at least one of the tubular member and the conveyor.

2. The developer cartridge according to claim 1, wherein
the conveyor is rotatable integrally with the tubular member relative to the casing, and
the end member is non-rotatable relative to the casing.

3. The developer cartridge according to claim 1, wherein
the tubular member is non-rotatable relative to the casing,
the conveyor is rotatable relative to the casing, and
the end member is rotatable integrally with the conveyor.

4. The developer cartridge according to claim 3, wherein
the conveyor includes a shaft, and
the end member has a diameter greater than a diameter of the shaft, and is rotatable integrally with the shaft.

5. The developer cartridge according to claim 1, wherein the conveyor includes an auger configured to rotate relative to the casing.

6. The developer cartridge according to claim 1, wherein
the conveyor includes a threaded shaft and a piston engaging with the threaded shaft, and
the tubular member includes a stopper that prevents the tubular member from rotating relative to the piston.

7. The developer cartridge according to claim 1, wherein
the sealing member includes a weakened portion weaker than other portions of the sealing member, and
the weakened portion is provided along a rotating direction of the at least one of the tubular member and the conveyor, and faces an outer peripheral surface of one of the tubular member and the end member.

8. The developer cartridge according to claim 7, wherein the weakened portion is a perforation.

9. The developer cartridge according to claim 1, wherein
the sealing member includes a weakened portion weaker than other portions of the sealing member, and
the weakened portion is provided along a rotating direction of the at least one of the tubular member and the conveyor, and is located between the tubular member and the end member.

10. The developer cartridge according to claim 9, wherein the weakened portion is a perforation.

11. The developer cartridge according to claim 1, further comprising a cutter provided at the conveyor and configured to rotate integrally with the conveyor, the cutter extending in a radial direction of the tubular member, wherein
the sealing member includes a cut portion to be cut by the cutter and a non-cut portion not to be cut by the cutter, and
the cut portion is disposed within an imaginary cylindrical plane whose radius is equal to a distance from an axis of the conveyor to a distal end of the cutter situated away from the axis of the conveyor, and the non-cut portion protrudes away from the cutter in the radial direction relative to the cut portion.

12. The developer cartridge according to claim 1, further comprising a developing roller rotatably supported by the casing.

13. The developer cartridge according to claim 1, further comprising a plurality of developer containers.

14. The developer cartridge according to claim 1, wherein the developer container includes a drive force transmitter on another end of the tubular member.

15. The developer cartridge according to claim 14, wherein the drive force transmitter includes a gear disposed outside the casing.

16. A developer cartridge comprising:
a casing; and
a developer container detachably attached to the casing and including:
a tubular member configured to contain developer therein and having an axis;
a conveyor disposed in the tubular member and configured to convey the developer toward one end of the tubular member along the axis;
an end member disposed on the one end of the tubular member; and
a sealing member attached to an outer peripheral surface of the end member and an outer peripheral surface of the tubular member and configured to be broken by relative rotation between the end member and the tubular member.

* * * * *